US012760652B2

(12) United States Patent
Mahanoğlu

(10) Patent No.: US 12,760,652 B2
(45) Date of Patent: Oct. 13, 2026

(54) VARIABLE TRAJECTORY NON-CIRCULAR DRIVE SYSTEM

(71) Applicant: Ali Mahir Mahanoğlu, Nilüfer (TR)

(72) Inventor: Ali Mahir Mahanoğlu, Nilüfer (TR)

( * ) Notice: Subject to any disclaimer, the term of this patent is extended or adjusted under 35 U.S.C. 154(b) by 0 days.

(21) Appl. No.: 18/863,419

(22) PCT Filed: May 10, 2023

(86) PCT No.: PCT/TR2023/050430

§ 371 (c)(1),
(2) Date: Nov. 6, 2024

(87) PCT Pub. No.: WO2023/224587

PCT Pub. Date: Nov. 23, 2023

(65) Prior Publication Data

US 2025/0305419 A1 Oct. 2, 2025

(30) Foreign Application Priority Data

May 11, 2022 (TR) ..... 2022/007682

(51) Int. Cl.
*F01D 7/00* (2006.01)
*F01D 15/00* (2006.01)
*B63H 1/08* (2006.01)

(52) U.S. Cl.
CPC ..... *F01D 7/00* (2013.01); *F01D 15/00* (2013.01); *B63H 1/08* (2013.01)

(58) Field of Classification Search
CPC .. F01D 7/00; F01D 15/00; B63H 1/06; B63H 1/08
See application file for complete search history.

(56) References Cited

U.S. PATENT DOCUMENTS 4,394,109 A * 7/1983 Ritchie ..... F01D 7/00 415/129
4,555,218 A * 11/1985 Jonsson ..... F01D 7/00 416/17
2010/0254799 A1 10/2010 Caines
2018/0080433 A1 3/2018 Te

FOREIGN PATENT DOCUMENTS

KR 20110103565 A 9/2011
TR 2020/00664 U 4/2020
TR 2020/06876 U4 11/2021

OTHER PUBLICATIONS

International Search Report for corresponding PCT/TR2023/050430 dated Feb. 27, 2024.
Written Opinion of the International Searching Authority for corresponding PCT/TR2023/050430 dated Feb. 27, 2024.

* cited by examiner

*Primary Examiner* — Michael L Sehn
(74) *Attorney, Agent, or Firm* — Egbert, McDaniel & Swartz, PLLC

(57) ABSTRACT

Disclosed is a variable trajectory non-circular drive (propulsion) system developed for use in all systems that have an energy relationship with air, such as aircraft, wind turbines, automobiles, ventilation and circulation systems, and fluid motion and drive systems. The system has a motion axis of a geometric shape that can be adjusted and which is non-circular instead of a circular route to ensure optimum efficiency. The system also has an adjustment mechanism that adjusts the geometric route of the axis of motion.

9 Claims, 6 Drawing Sheets

VARIABLE TRAJECTORY NON-CIRCULAR DRIVE SYSTEM

TECHNICAL FIELD

The invention relates to a variable trajectory non-circular drive (propulsion) system for use in all systems having an energy relationship with air, such as aircraft, wind turbines, automobiles, ventilation and circulation systems, and fluid motion and drive systems.

STATE OF ART

Conventional propellers, i.e. screw propellers, are a blade (K) profile formed by connecting a certain number and shape of blades/blades to a central hub connected to the engine crankshaft. The function of the propellers is to take the output power of the engine and provide a pulling or pushing force to the fluid, enabling the attached vehicle to hold and move forward in the relevant fluid. The disadvantage of conventional propellers compared to the circular system is that they are less efficient because each point along the blade (K) span shown in FIG. 7 rotates at different speeds as it moves in a circular horizontal system. Although each point is optimized separately, both blade (K) tip and regional losses occur. As the angular rotation speed of each point on the blade increases as we approach the tips of the blade (K), efficiency loss occurs. In order to prevent this, it is tried to reduce the efficiency loss by creating a blade (K) shape suitable for position-based speed. The circular propeller (cyclorotor) (D) is a drive system structure that converts shaft power into fluid acceleration by rotating on a circular axis using an axis rotating perpendicular to the direction of fluid motion. It uses a blade (D1) or blades (D1) with a spreading axis parallel to the axis of rotation and perpendicular to the direction of fluid motion, as shown in FIG. 8. Circular propellers (Cyclorotors) (D) produce thrust by rotating a fixed point of the blades around a center and continuously varying the angle of attack (D2) of the blades in one complete revolution. In other words, the blades (D1) are actuated with a positive pitch (outward from the center of the rotor) in the upper half of their revolution and a negative pitch (inward towards the axis of rotation) in the lower half, resulting in a net upward aerodynamic force and a downward airflow (D3) motion in the opposite direction. The thrust generated by the circular motion and the variation of the angles of attack (D2) of the blades (D1) produces a higher thrust at a lower speed than conventional propellers. In a typical circular propeller (D) structure shown in FIG. 9, the blade (K) angles of attack (D2) of the blades (D1) integrated in the circular trajectory differ at each position.

Existing systems used in the state of the art manipulate the flow direction by moving the entire drive (propulsion) system to direct the flow (tiltable drive systems). Additional flow-steering mechanisms can be added to the outlet (rudders, control surfaces and so on). In multiple drive (propulsion) systems, each system can be used individually or as a group (drone, quadcopter, etc.). The methods used in these systems cause a certain amount of efficiency loss (gyroscopic rotational resistance, drag increase, lift loss, etc.) depending on the work performed. In existing systems, flow performance cannot be optimized according to instantaneous needs. Existing systems are designed and manufactured according to the place where they will work and the work they will do during their service life. Only the speed and direction of movement can be changed according to need. This leads to certain losses in the instantaneous performance-efficiency balance. The operating principle of circular propellers (cyclorotors) (D) requires the angles of attack (D2) of the blade (D1) to be continuously changed throughout a complete cycle. The ideal angles of attack (D2) of the blade (D1) cannot be fully optimized according to their position in the circular motion, resulting in a loss of efficiency. In addition, all types of propellers in circular motion create gyroscopic rotational resistance due to their structure.

In order to overcome the problems experienced in existing systems, many studies have been carried out and new blade structures have been developed. One of these studies is the invention subject to the utility model application numbered TR 2020/06876 and titled "An Innovation in Vertical Wind Turbine Blade Structure". The invention is an innovation in a vertical axis wind turbine blade and is characterized by a vertical turbine shaft, at least one propeller located on this shaft and at least one blade of conical or cylindrical type fixed to the propeller and the upper shaft hub.

Another work is the invention subject to the utility model application numbered TR 2020/00664 and titled "New Wind Turbine Models with Horizontal and Vertical Axes that can take the wind to the Rotor Axis in Different Ways". The object of this invention is related to new wind turbine models with different horizontal and vertical axes; with double propeller blade groups, with large blades with horizontal axis without tail and with vertical axis.

As a result, the need for a variable trajectory non-circular drive (propulsion) system that eliminates the disadvantages of the existing art and the inadequacy of the existing solutions necessitated a development in the relevant art field.

BRIEF DESCRIPTION OF THE INVENTION

The present invention relates to a non circular drive (propulsion) system with variable trajectory, which meets the above-mentioned requirements, eliminates all disadvantages and brings some additional advantages, and is developed for use in all systems that have an energy relationship with air, such as aircraft, wind turbines, automobiles, ventilation and circulation systems, as well as in motion and drive systems in fluids.

Based on the state of the art, the object of the invention is to develop a new drive (propulsion) system by moving the vertical propeller concept on a non-circular axis of motion with variable trajectory.

The aim of the invention is to minimize the gyroscopic rotational resistance of all types of propellers in circular motion by means of a non-circular structure with variable trajectory. In addition, the working principle of circular vertical drive systems is to eliminate the need for continuously changing the angles of attack of the blade during a complete cycle (FIG. 9) and to eliminate the efficiency loss problems caused by the inability to fully optimize the ideal angles of attack of the blades according to their position in circular motion.

Another object of the invention is to ensure that, in a variable trajectory non-circular drive system, the ideal angle of attack of the tracks follows a non-circular axis so that the ideal angle of attack can be obtained and optimized along the entire path.

Another object of the invention that the ideal angle of attack is maintained along the non-circular axis of motion with variable trajectory and that the loss of efficiency is minimized, in contrast to circular vertical propellers (cyclorotors).

Another object of the invention that the suction and thrust axes of the work-producing blade are positioned in the optimum position with respect to the axis of motion (without complete rotation of the drive system, although it can be completely rotated if desired), so that the steering is carried out with maximum efficiency and minimum loss.

Another object of the invention is to enable the center of action of the work produced in the drive system to be changed in every plane thanks to the changeable motion trajectory in three dimensions, and to determine the most suitable size and position according to the current need and to enable the system to take the desired shape according to this configuration.

Another object of the invention is to enable the force direction to be changed without the need to change the direction of the fluid and the direction of the drive system by changing the shape of each variable trajectory non-circular motion axis independently or together.

Another object of the invention is to increase the efficiency of the system by means of the movable surfaces that can be placed on the blade and the angles of attack of the blades passing through each axis can be changed.

Another object of the invention is to enable the angle of attack to be optimized independently in each axis of motion thanks to the structure of the developed variable trajectory non-circular drive system.

Another object of the invention is to minimize gyroscopic rotational resistance losses by positioning the suction and thrust axes of the work-producing blades relative to the axis of motion.

Another object of the invention is to enable the drive system to perform the desired work with high efficiency by adjusting the working surface on each axis as a suction or thrust surface according to the need.

The structural and characteristic features and all advantages of the invention will be more clearly understood by means of the following figures and the detailed description written by referring to these figures, therefore, the evaluation should be made by considering these figures and detailed descriptions

BRIEF DESCRIPTION OF FIGURES

For a better understanding of the structure of the present invention and its advantages with additional elements, it should be evaluated together with the figures described below.

REFERENCE NUMBERS

Figure 1:
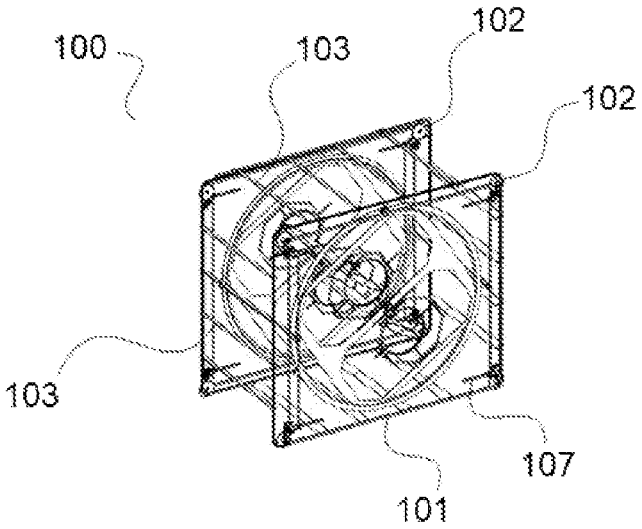
FIG. 1 is a schematic overview of a variable trajectory non-circular drive (propulsion) system.

100. Variable trajectory non-circular drive system
101. Axis of motion
102. Drive unit
103. Blade
104. Blade positioning guide
105. Moving surface
106. Speed and direction control unit
107. Adjustment mechanism
108. Blade position and/or width adjustment mechanism
109. Support surface
110. Support surface control mechanism
111. Flow manipulator
K: Conventional propeller blade of state of the art
D: Circular propeller of state of the art
D1: Blade of a circular propeller in the state of the art
D2: Angle of attack mechanism of a circular propeller in the state of the art
D3: Air flow in a circular propeller in the state of the art

DETAILED DESCRIPTION OF THE INVENTION

In this detailed description, the variable trajectory non-circular drive (propulsion) system (100), subject to the invention, developed for use in all systems that have an energy relationship with air, such as aircraft, wind turbines, automobiles, ventilation and circulation systems, and motion and drive systems in fluids, is described only as an example for a better understanding of the subject matter and without any limiting effect.

Figure 2:
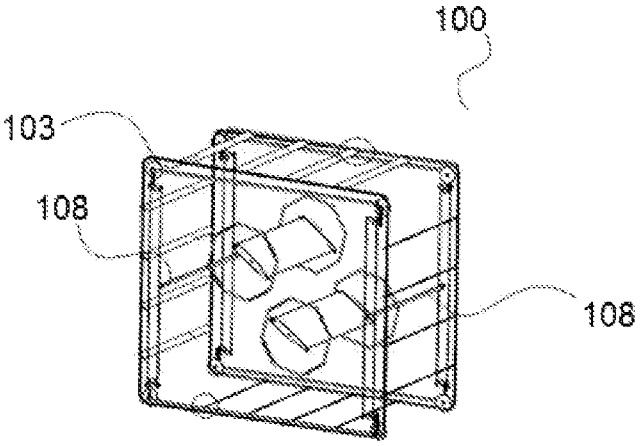
FIG. 2 is a schematic overview of the adjustment mechanism, FIG. 3*a;* schematic detail view of the non-trajectory support surface and support surface control mechanism.
Figure 4:
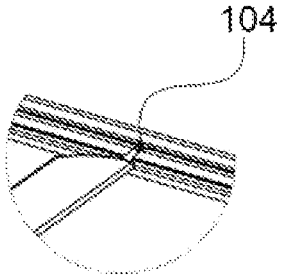
FIG. 4 is a schematic detail view of the schematic detail view of the suction thrust direction blade positioning guide on the non-circular motion axis with variable trajectory.

A new and unique variable trajectory non-circular drive system (100) has been developed in which the blades (103), which have different profile structures, symmetrical or non-symmetrical, with various angles of attack, various sizes, various geometric structures, various numbers and which can be positioned at different unit distances and different positions, follow the axis of motion (101) to generate the transport force. The inventive variable trajectory non-circular drive system (100), shown in FIG. 1, includes an adjustment mechanism (107), shown in FIG. 2, which forms a geometric route that can be adjusted according to the need on the axis of motion (101), the blade (103) that moves and performs the defined work on this axis of motion (101), the blade position and/or width adjustment mechanism (108) and the position of the track (103) with the suction thrust direction track positioning guide (104) on the non-circular axis of motion (101) shown in FIG. 4, if it includes speed, wingspan, angle of attack and moving surface (105), it comprises a speed and direction control unit (106) on the moving surface (105) and a drive (propulsion) unit (102)

comprises a speed-adjustable blade (103) or blades (103), which transfers energy to the blade (103) or blades (103) to perform the work defined along the axis of movement (101) in the geometric route set according to the need. The fact that the functioning surfaces in each axis can be adjusted as suction or thrust surfaces according to the need enables the variable trajectory non-circular drive system (100) to perform the desired work with high efficiency.

Figure 3A:
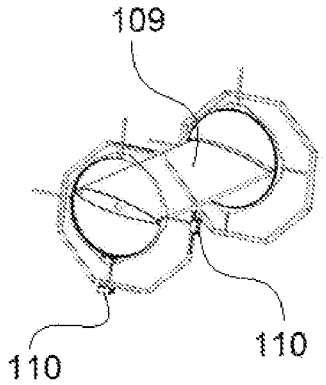
FIG. 3*b* is a schematic detail view of the trajectory support surface and the support surface control mechanism, (The trajectory support surface can be connected to the trajectory position without moving with the blades, or it can be positioned in a suitable place on the blades and move with it, the number and positions in the system vary completely depending on the needs)
FIG. 3*c* is a perspective drawing of a schematic view of the flow manipulator positioned on the support surface in a preferred embodiment of the invention.
FIG. 3*d* is a two-dimensional drawing of a schematic view of the flow manipulator positioned on the support surface in a preferred embodiment of the invention.
Figure 3B:
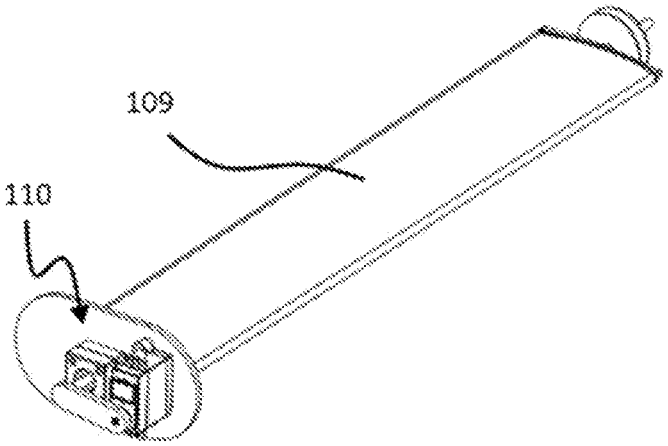
Figure 3C:
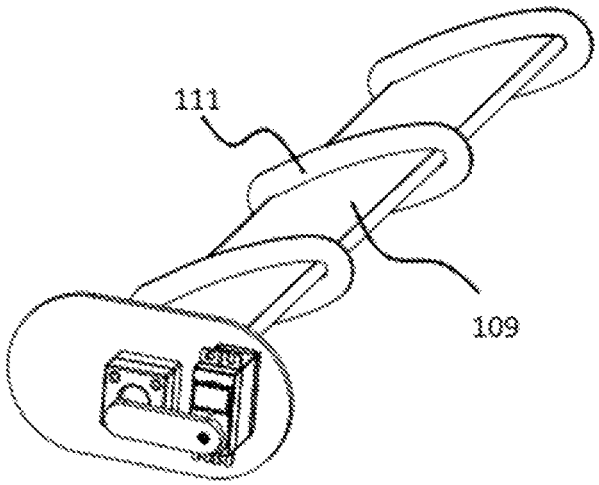
Figure 3D:
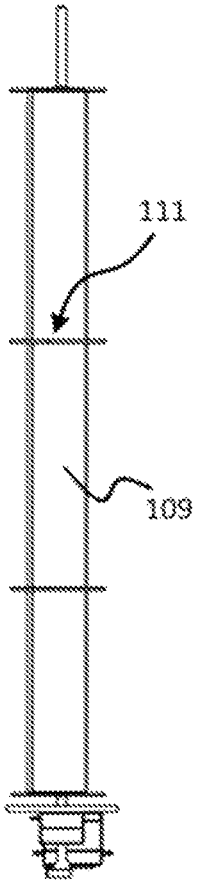

In the inventive variable trajectory non-circular drive system (100), the positioning of the suction and thrust axes of the work-producing blades (103) relative to the axis of motion (101) minimizes gyroscopic rotational resistance losses. In the inventive variable trajectory non-circular drive system (100), the optimum positioning of the suction and thrust axes of the work-producing blades (103) in relation to the axis of motion (101) (without rotating the drive unit (102), although the drive unit (102) can be rotated completely if desired) enables steering to be realized with minimum loss at maximum efficiency. The ability to vary the motion trajectory in three dimensions allows the center of action of the work produced on the drive unit (102) to be changed in any plane. Since the dimensions of the aforementioned variable trajectory non-circular drive system (100) can be changed in three dimensions, the most suitable size can be determined according to the current need and the system (100) can take the desired shape according to this configuration. In addition, the movable surfaces (105) that can be placed on the blade (103) of the variable trajectory non-circular drive system (100), and the ability to change the angles of attack of the blades (103) passing through each axis of motion (101) also contribute to increasing efficiency. The shape of the axis of motion (101) can also be changed independently. By changing these axes together, the force direction can be changed without the need to change the fluid direction and the direction of the drive unit (102). Said variable trajectory non-circular drive system (100) comprises a body to which blades (103) moving on the axis of motion (101) are connected, and blades (103) position and/or width adjustment mechanism (108) for adjusting the suction-push position of the blades (103) in three dimensional axes and the total blades width. In the aforementioned variable trajectory non-circular drive system (100), the flow control and/or the support surface (109), which performs the defined work, which can have a moving surface on it and which is in orbit or not in orbit, which can be placed in its optimum position, is positioned in the optimum position in the three-dimensional plane by means of the support surface control mechanism (110). FIG. 3*a* shows the off-trajectory support surface (109).

Figure 5:
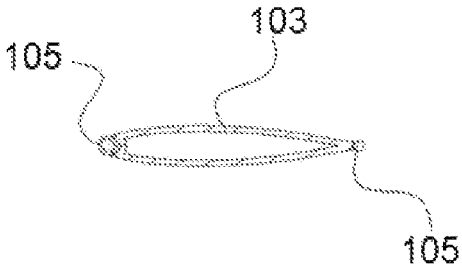
FIG. 5 is a schematic detail view of an example moving surface system.
Figure 6:
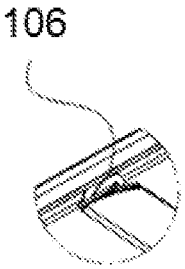
FIG. 6 is a schematic overview of the speed and direction control system on the moving surface.
Figure 7:
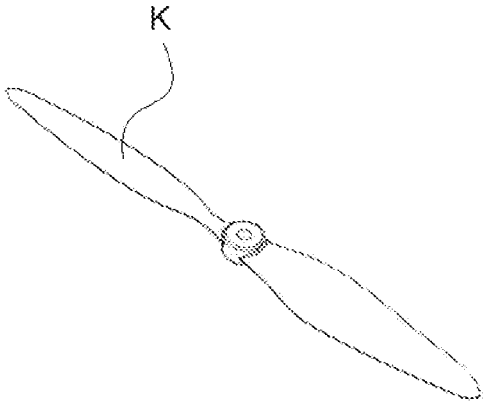
FIG. 7 is a schematic overview of the blade in the known state of the art.
Figure 8:
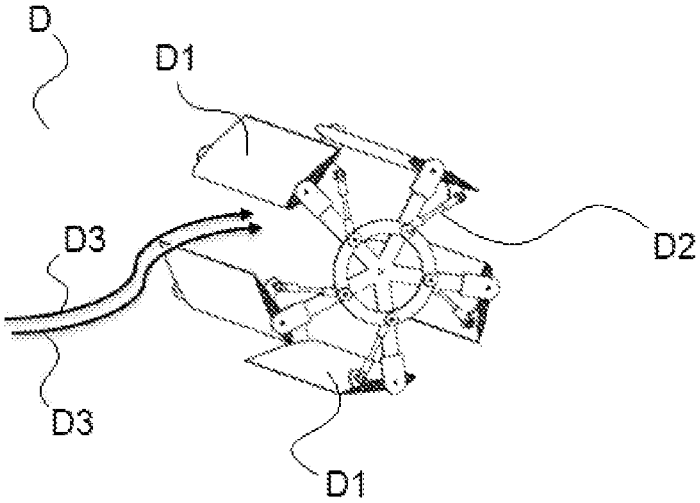
FIG. 8 is a schematic overview of the circular drive system in the state of the art.
Figure 9:
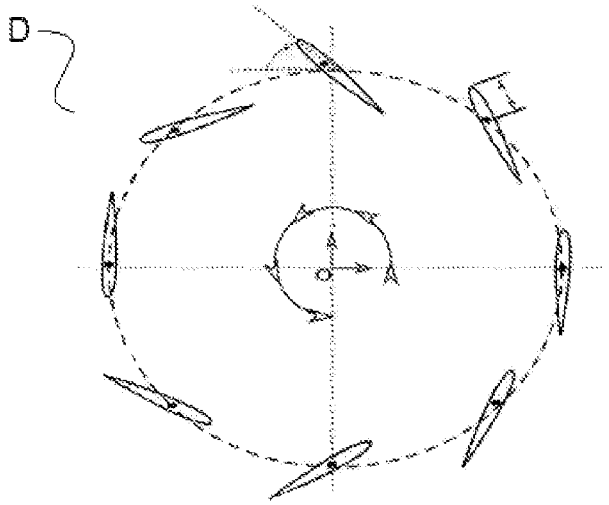
FIG. 9 is a schematic overview of a typical circular propeller structure with the blades integrated in a circular trajectory.

In the aforementioned variable trajectory non-circular drive system (100), since the ideal angle of attack of the blades (103) follows a non-circular axis, the ideal angle of attack with optimum efficiency is maintained throughout the entire path and there is no loss of efficiency unlike circular propellers (cyclorotors). In addition to these gains, the concept of variable trajectory non-circular drive (propulsion) can be further improved with the concept of boundary layer control if desired. At this point, the efficiency of the drive unit (102) can be further increased with the independent moving surface (105) that can be positioned at suitable locations along the entire wing axis (span) of the blade (103). The moving surface (105) shown in FIG. 5 can move at a variable speed according to the general rotation speed of the blades (103). This movement is realized on the moving surface (105) by the speed and direction control unit (106) shown in FIG. 6. This mechanism also adjusts the speed and direction of rotation of the moving surface. The angle of loss of grip (stall) is also delayed due to the inclusion of the moving surface (105). Ultimately, the improved aerodynamic efficiency of the blades (103) is created by placing them in various combinations.

Moving surfaces (105) placed at the appropriate position of the mentioned blade (103) have an important function in controlling the boundary layer and improving the overall aerodynamic and hydrodynamic fluid parameters. A blade (103) with a fixed surface only starts to operate when it starts to move at a suitable angle, whereas a blade (103) with moving surfaces (105) operates at much lower speeds, over a wider range of blade (103) angles of attack and with higher efficiency.

This can be explained by the Magnus effect, which states that a surface moving at a given speed always exerts an upward force on the moving surface (105) at right angles to the axis of motion (101). This helps to reduce the friction generated and increases the throughput of work produced on the blades (103).

The support surface (109) shown in FIG. 3*a* (the support surface (109) shown in FIG. 3*a* is off-trajectory) is a system that can be placed in the optimum position of the variable trajectory non-circular drive system (100) when it is desired to be used, and can accommodate a moving surface (105) that performs flow control and/or defined work. These surfaces support the defined work by taking the most appropriate position according to the direction of fluid movement by means of the support surface control mechanism (110), which is on trajectory (if the support surface (109) is on trajectory) or not on trajectory (if the support surface (109) is not on trajectory).

The off-trajectory support surface control mechanism (110) ensures that one or more off-trajectory support surfaces (109) are positioned in the optimum dimensions and position for both flow control and for performing the defined work. Similarly, the trajectory support surface control mechanism (110) ensures that one or more trajectory support surfaces (109) are positioned in the optimum dimensions and position for both flow control and the defined work to be performed.

Unlike conventional propellers (screw propellers) (K), both the variable trajectory non-circular drive system (100) and the circular systems operate at constant speed over the entire blade span. This allows them to operate at the highest efficiency along all points of the blade span. Studies on circular propellers (D) have shown that they can be much more efficient in terms of thrust than conventional propeller systems.

In a preferred embodiment of the invention, the variable trajectory non-circular drive system (100) may comprise a single axis of motion (101) or multiple axes of motion (101).

In another preferred embodiment of the invention, induced drag reducers are added in the appropriate place of the blades (103) in order to increase the efficiency of the blades (103) in case of need. In addition, drag reducers are also used on all other surfaces in contact with the fluid in the inventive variable trajectory drive (propulsion) system.

In another preferred embodiment of the invention, the variable trajectory non-circular drive system (100) can operate open, or the inlet and outlet velocities of the fluid can be changed and a wall of suitable geometry is added to increase efficiency.

By the invention, the variable trajectory non-circular drive system (100), the inlet and outlet directions of the fluid flowing through the system can be changed independently. If necessary, regional bearing force differences can be created by changing the movement trajectory of the system along the axis or axes for optimum results in accordance with the desired work in three different axes of the system. This again causes regional bearing force differences. In this way, depending on where the variable trajectory non-circular drive system (100) is to be used, the inlet and outlet directions of the fluid can be changed separately without the need for any control surface or directional rudder. For example, if the variable trajectory non-circular drive system (100) is used in an aircraft, the vehicle can be steered without the use of a flight control surface or a directional rudder (although a control surface and a directional rudder can be used if required). The same principle applies to surface or underwater vehicles. The maneuvers can be performed by the internal dynamics of the variable trajectory non-circular drive system (100) without the need for additional directional and maneuvering rudder systems, their associated additional weight, manufacturing and design costs, thus avoiding process losses. The principle is basically based on the localized force differences of the fluids flowing through the variable trajectory non-circular drive system (100), which are created by the optimum trajectory created in three dimensions, depending on the needs within the system.

The inventive variable trajectory non-circular drive system (100) is structurally subject to instantaneous volume changes when in operation due to its changeable trajectory. In addition, when not in use, its volume can be further reduced for space optimization or other reasons.

In the inventive variable trajectory non-circular drive system (100), the fluid contact surfaces of the operating surfaces (blades (103)) are further enlarged in three dimensions to increase the contact surface with the fluid when desired. In addition, the suction and thrust forces are increased. This results in improved energy efficiency.

The blades (103) can be used on the on-trajectory support surface (109) and the off-trajectory support surface (109), as well as on all surfaces in contact with the fluid. In another embodiment of the invention, in addition to the moving surfaces that we have implemented within the concept of boundary layer control to improve flow performance, in order to allow this use of blades (103) that perform the defined work, the followings have been added:

at least one surface accelerator and at least one flow manipulator (111), that can affect fluid movement.

Mentioned surface accelerators may be produced from the following materials:

- material that changes the ionization of surfaces in contact with the fluid-material that changes the fluid resistance (dielectric material) or,
- chemicals that give surface smoothness (nano surface coating chemicals, polyamide coatings, polishes, etc.) or
- aerodynamic coating material (made of polymer/polymeric materials polyolefins/polyethylene, PP, polybutenes in the thermoplastic group of synthetic polymers) or
- plasma polymerization coating (made of polymer/polymeric materials-polyolefins/polyethylene, PP, polybutenes in the thermoplastic group in the class of synthetic polymers)

On the other hand, flow manipulators (111) can be exemplified as a small blade/protrusion. Said blade/protrusion can be positioned anywhere on the surfaces in contact with the fluid (the surface of the elements of the system, such as the surface of the blades (103), support control surfaces, induced drag reducers, etc.).

In another embodiment of the invention, suitable locations in the inventive system may be covered with photovoltaic systems or other similar energy-efficient materials.

In the inventive system, the motion trajectory can be changed in all axes depending on the work performed in an efficiency-oriented manner. Furthermore, in general, the distances between the blades (103) and all sub-systems on them can be increased or decreased in volume and system dimensions in all three axes, including the axis representing the blade spans.

The invention claimed is:

1. A variable trajectory non-circular drive system for use in a system that has a relationship with a fluid, the variable trajectory non-circular drive system comprising:

a plurality of blades;

a body connected to said plurality of blades;

a motion axis having an adjustable geometric shape, the motion axis being non-circular; and a blade adjuster cooperative with said motion axis so as to adjust a geometric route of said motion axis, said blade adjuster cooperative with each blade of said plurality of blades so as to adjust a suction-thrust position of each blade of said plurality of blades in three-dimensional axes and sets a total blade width by a movement of said body connected to said plurality of blades.

2. The variable trajectory non-circular drive system of claim 1, further comprising:

a plurality of movable surfaces positioned on each blade of said plurality of blades, said plurality of movable surfaces adjusting an angle of attack of each blade.

3. The variable trajectory non-circular drive system of claim 2, further comprising:

a blade angle of attack positioning guide cooperative with each blade so as to fix said blade at the angle of attack.

4. The variable trajectory non-circular drive system of claim 1, further comprising:

an off-trajectory support surface that accommodates a flow control for a moving surface, said off-trajectory support surface being positionable.

5. The variable trajectory non-circular drive system of claim 1, further comprising:

an on-trajectory support surface that connects to a moving surface so as to position the moving surface for flow control for positioning a workpiece.

6. The variable trajectory non-circular drive system of claim 1, further comprising:

at least one surface accelerator that directs a motion of the fluid.

7. The variable trajectory non-circular drive system of claim 6, wherein the at least one surface accelerator is formed of a material selected from the group consisting of a material that changes an ionization of surfaces in contact with the fluid, a chemical material that imparts a surface smoothness, an aerodynamic coating material, and a plasma polymerization coating material.

8. The variable trajectory non-circular drive system of claim 1, further comprising:

at least one flow manipulator that directs a motion of the fluid.

9. The variable trajectory non-circular drive system of claim 8, wherein said at least one flow manipulator is a blade or a protrusion positioned on a surface in contact with the fluid.

* * * * *